US005987650A

United States Patent [19]

Carroll

[11] Patent Number: 5,987,650

[45] Date of Patent: Nov. 23, 1999

[54] SWIM GOOGLE RETAINING DEVICE FOR SWIM WEAR

[76] Inventor: Constance Carroll, 25 Evergreen Rd., Greenwich, Conn. 06830

[21] Appl. No.: 09/003,945

[22] Filed: Jan. 8, 1998

[51] Int. Cl.[6] ..... A41D 27/08

[52] U.S. Cl. ..... 2/244; 2/104; 2/67

[58] Field of Search ..... 2/46, 67, 48, 49.1, 2/49.2, 49.3, 49.4, 49.5, 50, 51, 52, 94, 101, 104, 113, 114, 115, 108, 145, 338, 300

[56] References Cited

U.S. PATENT DOCUMENTS

| | | | |
|---|---|---|---|
| Re. 30,899 | 4/1982 | Kallman | 24/3 |
| 2,006,427 | 7/1935 | Wolfson | 2/145 |
| 4,168,544 | 9/1979 | Kallman | 2/94 |
| 4,458,384 | 7/1984 | Arnold | 24/3 |
| 4,771,478 | 9/1988 | Bisagno et al. | 2/69 |
| 4,975,987 | 12/1990 | Teachout et al. | 2/244 |
| 5,119,979 | 6/1992 | Kallman | 224/250 |
| 5,815,834 | 10/1998 | Bronson | 2/94 |

*Primary Examiner*—Diana Oleksa
*Assistant Examiner*—Kate Moran
*Attorney, Agent, or Firm*—Finnegan Henderson Farabow Garrett & Dunner, LLP

[57] ABSTRACT

An article of swim wear with a retaining device for swim goggles having a pair of lens frames separated by a nose piece, where the article of swim wear includes a loop of flexible material affixed to an exterior portion of a swimsuit. The loop possesses a inner periphery related to either the lens frame or the nose piece of the pair of swim goggles. The swim goggles are retained by the loop about their nose piece by either the insertion of one of the lens frames of the swim goggles through the inner periphery of the loop or the formation of the loop itself.

34 Claims, 4 Drawing Sheets

SWIM GOOGLE RETAINING DEVICE FOR SWIM WEAR

BACKGROUND OF THE INVENTION

1. Field of the Invention

This invention relates to swim wear and more particularly to an article of swim wear with a retaining device for swim goggles.

2. Background of the Invention

Since the advent of the swimsuit, swim wear usage has increased dramatically where its present use ranges from that of competitive sporting events to simple recreational activities. During this evolutionary period, swim goggles have emerged as a technique for protecting the eyes of the swimmer from exposure to water. Accordingly, swim goggles have become a common piece of equipment for any swimmer. In response to this broad range of use, swim wear designers have developed numerous design variations to the basic swimsuit to accommodate swim goggles. However, these variations have failed to devise an uncomplicated technique for retaining a pair of swim goggles in their periods of non-use.

Although there presently exist devices for retaining eye wear to an article of clothing, the procedures and configurations of these devices are incompatible for the retention of swim goggles to a swimsuit. The techniques currently used for eye wear retention are cumbersome and complex to manipulate and, therefore, impractical for normal use. For example, one such eye wear retention device, as shown in U.S. Pat. No. 5,119,979, requires that the position of the eye wear holder be limited to the pocket or waistband of an article of clothing. This same device also requires the manipulation of multiple strips prior to the retention of the eye wear. Further, this device, and other eye wear retention devices, limit their application to eyeglasses having a pair of eyeglass frames adapted to hold the eye wear along the temples of the wearer. The temple frames are required elements as the eye wear holder retains the eyeglasses to the article of clothing by the temple frames. Because of these considerations, the devices currently available for eye wear retention are impractical for retaining a pair of swim goggles to an article of swim wear. As such, swim goggles are typically removed and held by the user during their periods of non-use.

In view of the limitations and complexity of existing eye wear holders, a need has arisen, particularly among children, for retaining a pair of swim goggles on a swimsuit which is simple in its application and construction.

SUMMARY OF THE INVENTION

The advantages and purpose of the invention will be set forth in part in the description which follows, and in part will be obvious from the description, or may be learned by practice of the invention. The advantages and purpose of the invention will be realized and attained by the elements and combinations particularly pointed out in the appended claims.

To obtain the advantages and in accordance with the purpose of the present invention, as embodied and broadly described herein, the invention is directed to an article of swim wear for retaining a pair of swim goggles having a pair of lens frames constructed of either rigid or elastomeric material and spaced by a nose piece. The invention comprises a swimsuit having an exterior portion and a loop of flexible material. The loop, which is affixed to the exterior portion of the swimsuit, has an inner periphery related to the lens frame of the swim goggles. The inner periphery of the loop enables one of the pair of lens frames to be inserted through the loop upon expanding the loop, flexing the elastomeric material of the one lens frame, or both. Once the first lens frame is inserted, the swim goggles are retained by engagement of the loop with the nose piece of the swim goggles.

Alternatively, the strip forming the loop may be detachable and not necessarily flexible. However, when the strip is attached, the loop should define an inner periphery sufficient to restrict insertion or removal of the swim goggles without detaching the loop or twisting at least one of the lens frames of the swim goggles.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENTS

Reference will now be made in detail to the present embodiments of the invention, examples of which are illustrated in the accompanying drawings. Wherever possible, the same reference numbers will be used throughout the drawings to refer to the same or like parts.

In accordance with the present invention, there is provided an article of swim wear with an unobtrusive retaining device for swim goggles. The article of swim wear includes a swimsuit with a loop of flexible material affixed to an exterior portion of the swimsuit and configured to receive and retain a pair of swim goggles. The article of swim wear, as described, enables individuals to easily store their swim goggles during any interim period of non-use.

Figure 1:
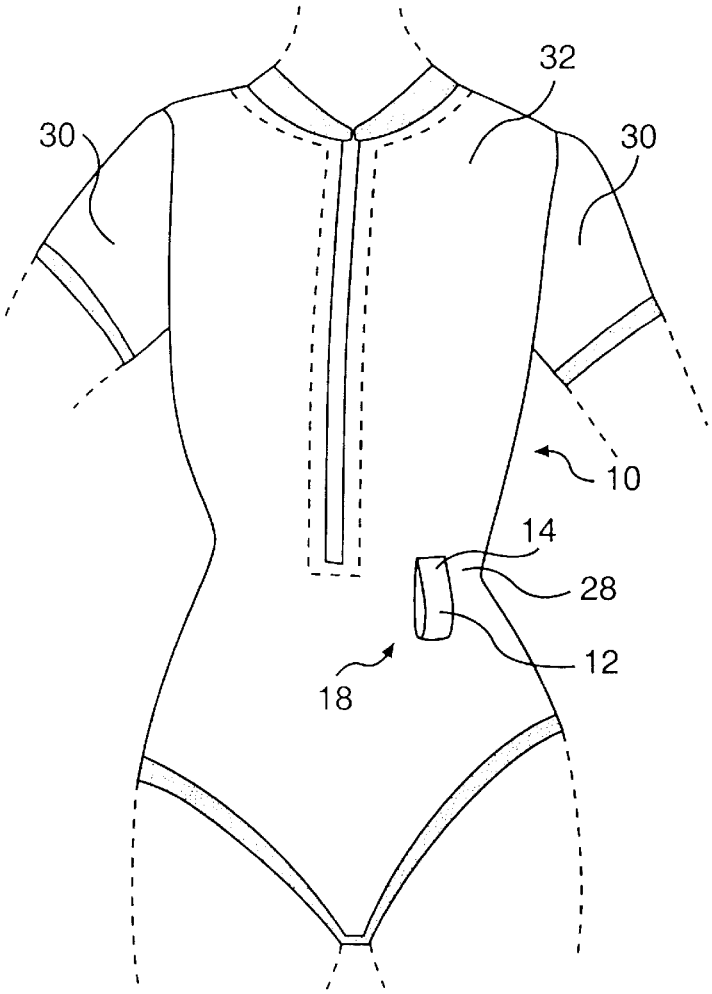
FIG. 1 is a front view of an embodiment of an article of swim wear according to the present invention.
Figure 2:
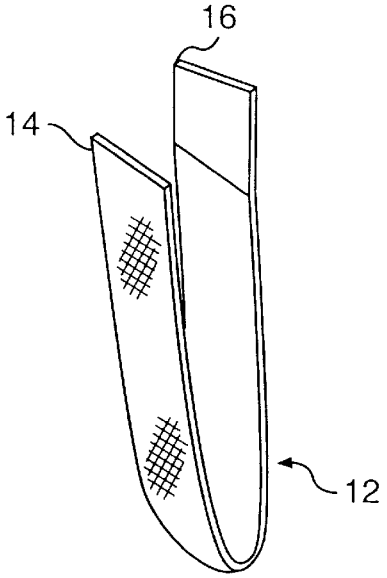
FIG. 2 is a perspective view of the embodiment showing a first variation of a loop according to the present invention.
Figure 3:
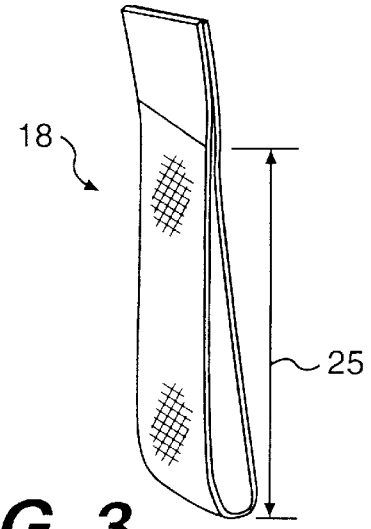
FIG. 3 is a perspective view of the embodiment showing the first variation of the loop according to the present invention.
Figure 5:
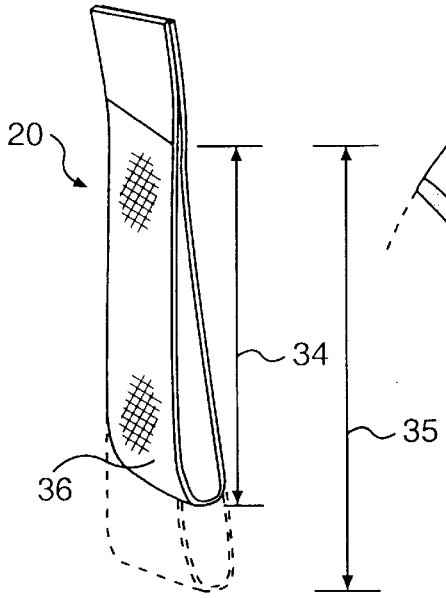
FIG. 5 is a perspective view of the embodiment showing a second variation of the loop according to the present invention.

FIGS. 1–3 illustrate an embodiment of an article of swim wear according to the present invention and for retaining a pair of swim goggles possessing a pair of lens frames of elastomeric material and spaced by a nose piece. As illustrated in FIG. 1, the article of swim wear includes swimsuit 10 with a strip 12 of flexible material having ends 14, 16 affixed to an exterior portion of swimsuit 10 to form a loop 18. Accordingly, the loop 18 preferably is double-ended, whereby the opposing ends 14, 16 are affixed to the swimsuit exterior to form the loop. Other embodiments include a flexible elastic loop 20, as generally shown in FIG. 5. Alternatively, it may be advantageous to have a detachable loop, as indicated by reference numerals 22 and 24 in FIGS. 7–14. The invention further contemplates an endless loop of rigid or flexible material which is adapted to be secured to a swimsuit. The material of the loop may be fabric or plastic.

The first embodiment of loop 18 is depicted in expanded detail in FIGS. 2 and 3. Loop 18 has an inner periphery 25 related to the lens frame of the swim goggles. The dimension of inner periphery 25 allows one of the pair of lens frames of the swim goggles to insert through loop 18 upon the flexing of the elastomeric material of the one lens frame. Once the one lens frame is inserted, the swim goggles are retained by engagement of loop 18 with the nose piece of the swim goggles. The dimension of the inner periphery 25 of loop 18 is such that once the one lens frame is inserted through the loop, removal of the swim goggles from loop 18 is restricted to the reflexing of the elastomeric material of the lens frame.

The retainment technique offered by this article of swim wear enables the user to easily store their swim goggles as there exists neither complicated procedures nor burdensome limitations. The essential step for retaining the swim goggles to the swimsuit requires only the simple flexing and insertion of the one lens frame of the swim goggles through the loop. Once this one lens frame is inserted, the swim goggles are retained until later use. As designed, the application of the retainment device is easily accomplished, where the physical and mental capabilities of the user may be that of only a young child. In addition to its ease of use, there are minimal limitations imposed on the swim wear structure as the placement of the loop in relation to the swimsuit exterior involves minor restrictions. For example, the loop of fabric may be affixed to the swimsuit exterior at various body locations depending principally on the swimsuit type.

In addition to its various potential locations, the loop of the article of swim wear affixes to the exterior portion of the swimsuit by various means. One such means includes stitching the loop to the swimsuit exterior. Stitching the loop to the swimsuit exterior provides a secure attachment for the retainment device that creates minimal discomfort in the normal usage of the swimsuit.

Another such means for affixing the loop of includes pasting the loop to the exterior portion of the swimsuit. Similar to stitching, pasting the loop provides a secure attachment to the swimsuit exterior that again creates minimal discomfort in the normal usage of the swimsuit.

Figure 4:
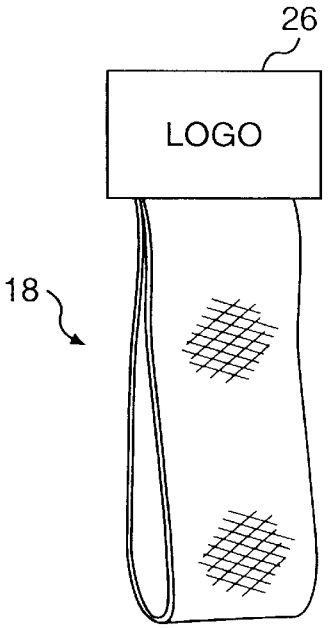
FIG. 4 is a perspective view of the embodiment showing the first variation of the loop according to the present invention.

As illustrated in FIG. 4, both of these means for affixing the loop to the swimsuit exterior may be complemented by label 26 superimposing the junction between the loop and the swimsuit exterior. Label 26, in addition to covering the junction, may serve as an information display, where the information displayed may include an advertising logo.

Typically, the swimsuit of the article of swim wear may be of several different types where the type of swimsuit may exclude certain placement areas for affixing the loop. In general, the swimsuit may be either a male, female, or unisex suit where its material may either conform to the individual's body or drape loosely to it. Where the material conforms to the body of the individual, several variations have evolved from the basic bodysuit. These variations include, for example, swim wear resembling a vest or jacket.

Because of the many variations in swimsuit type, a preferred placement for affixing the loop to the swimsuit exterior, as illustrated in FIG. 1, is at hip area 28 of swimsuit 10. Other common placement areas may include, for example, sleeve area 30 or chest area 32 of swimsuit 10. However, depending on the type of swimsuit, placement of the loop at certain body locations may be impossible as the suit may not cover these areas. Nonetheless, the loop may be affixed to any exterior portion of the swimsuit as it is not limited to an edge or pocket of the swimsuit.

As illustrated alternatively in FIG. 5, loop 20 is made of flexible elastic material. Again, loop 20 has inner periphery 34. Inner periphery 34 may increase in length by pulling end 36 of loop 20. Because of its flexible characteristics, loop 20 stretches to inner periphery 35. As increased, the dimension of the inner periphery 35 allows the insertion of one of the pair of lens frames of the swim goggles. Once the one lens frame is inserted, the elasticity of loop 20 causes inner periphery 35 to return to substantially its original dimension, and thus retain the swim goggles by the engagement of loop 20 with the nose piece of the swim goggles. The original dimension of inner periphery 34 of loop 20 is such that the removal of the swim goggles from loop 20 is restricted to the restretching of loop 20.

This variation enables the user to easily store their swim goggles in situations where the pair of lens frames of the swim goggles are constructed of a non-elastomeric material. In such situations, the elasticity of the loop allows the inner periphery to expand to a desired length to allow the insertion of the one lens frame of the swim goggles. Once the one lens frame is inserted, the elastic material of the loop returns to substantially its original inner periphery to retain the swim goggles about the nose piece. The elasticity of the loop provides the user with a technique for retaining a pair of swim goggles that involves neither complicated procedures nor burdensome limitations.

Figure 6:
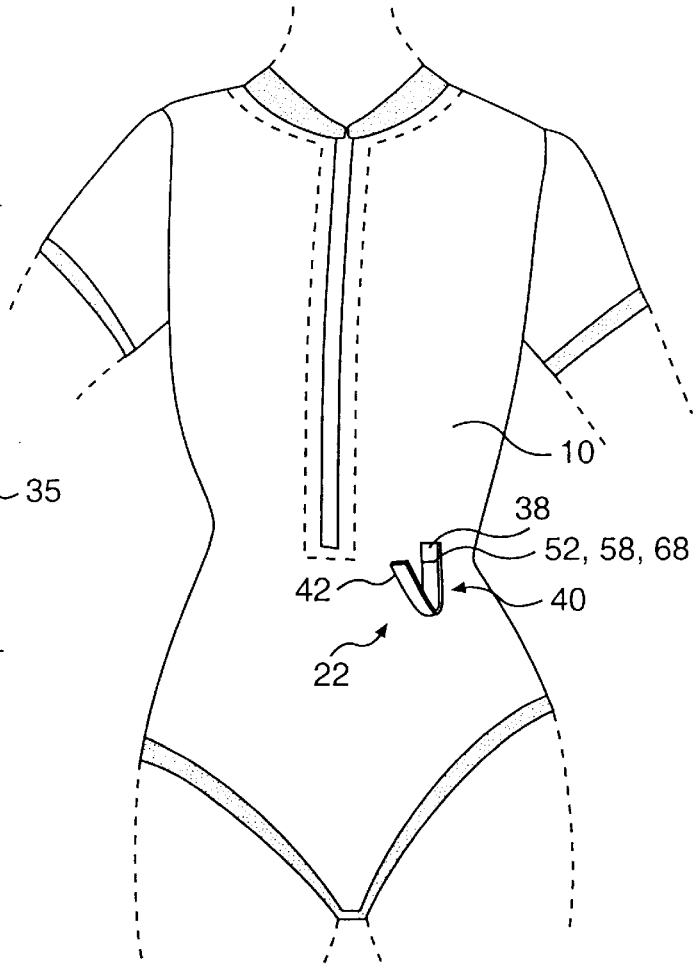
FIG. 6 is a front view of the embodiment showing a third variation of the loop according to the present invention.
Figure 8:
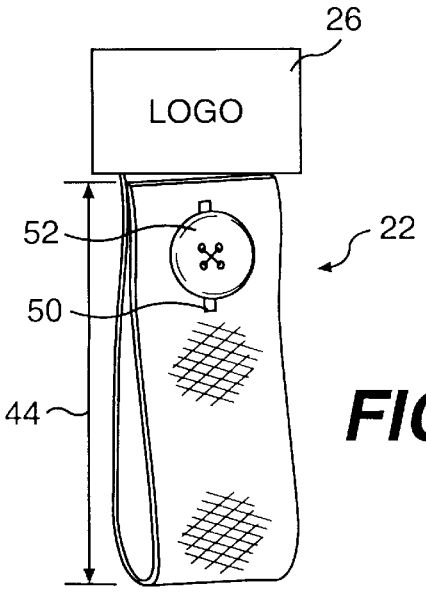
FIG. 8 is a perspective view of the embodiment showing a third variation of the loop according to the present invention.
Figure 10:
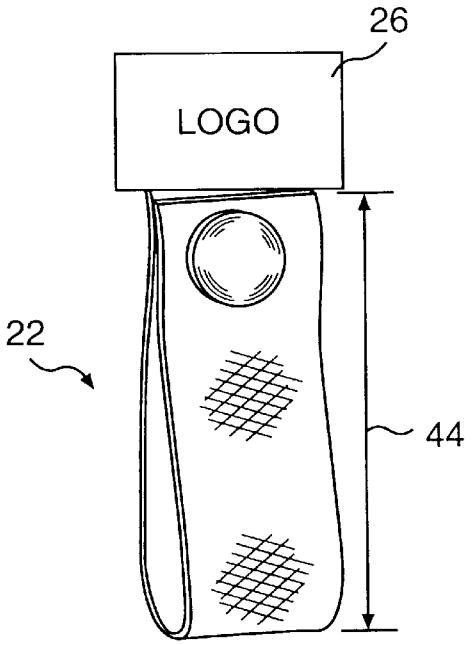
FIG. 10 is a perspective view of the embodiment showing a third variation of the loop according to the present invention.

In another variation, as illustrated in FIG. 6, loop 22 is formed by affixing first end 38 of strip 40 to the exterior of swimsuit 10 and removably affixing second end 42 of strip 40 to first end 38. As illustrated in FIGS. 8 and 10, loop 22, as formed, has an inner periphery 44 related to the nose piece of the swim goggles. By affixing second end 42 of strip 40 while the nose piece of the swim goggles resides on strip 40, the formation of loop 22 retains the swim goggles about their nose piece. The dimension of the inner periphery 44 is such that removal of the swim goggles is restricted to the opening of loop 22. Loop 22, once formed, may be opened by removing the second end 42 of strip 40 from first end 38.

Depending upon the circumstances, an individual may require several swim goggles of differing lens frames. In such situations, the removable attachment of second end 42 of strip 40 to first end 38 allows the individual to retain a variety of swim goggles regardless of their lens frame dimensions. The essential step for retaining the swim goggles requires only the disposal of the nose piece of the swim goggles on to strip 40 prior to formation of loop 22. As described, this variation enables an individual to easily retain various types of swim goggles to their swim wear without unduly complicating the procedures or construction of the present invention.

Figure 7:
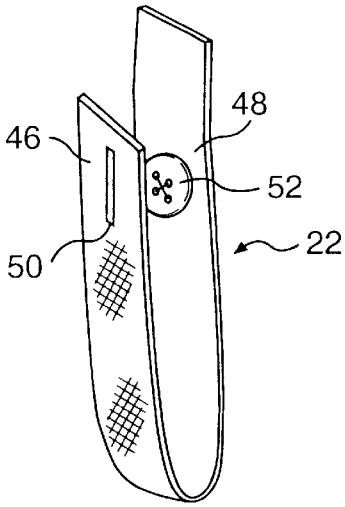
FIG. 7 is a perspective view of the embodiment showing a third variation of the loop according to the present invention.

Second end 42 of strip 40 may removably affix to first end 38 of strip 40 by various means. One such means, as illustrated in FIGS. 7 and 8, includes buttoning second end 46 to first end 48. To enable its buttoning, second end 46 includes button slot 50 for removably receiving button 52 attached to first end 48. Buttoning second end 46 provides a secure removable attachment for the retainment device that creates minimal discomfort in the normal usage of the swimsuit.

Figure 9:
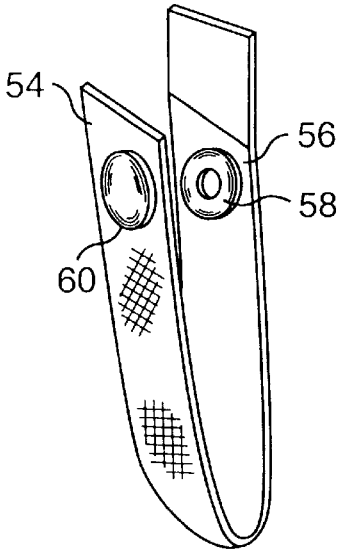
FIG. 9 is a perspective view of the embodiment showing a third variation of the loop according to the present invention.

As illustrated in FIGS. 9 and 10, another such means for removably affixing second end 54 includes snapping second end 54 to first end 56. To enable the snapping, first end 56 and second end 54 include respective complementary structures 58, 60 that removably interlock once imposed onto one another. Similar to buttoning, snapping second end 54 provides a secure removable attachment for the swim goggle retainment device that creates minimal discomfort in the normal usage of the swimsuit.

Figure 11:
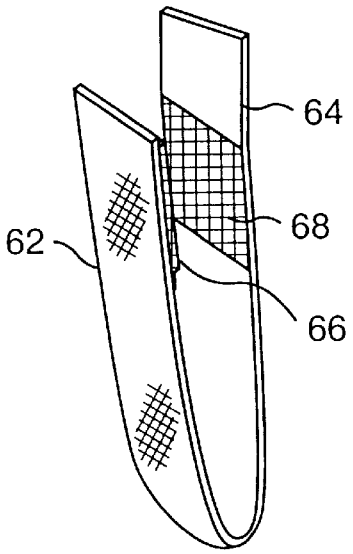
FIG. 11 is a perspective view of the embodiment showing a third variation of the loop according to the present invention.

As illustrated in FIG. 11, still another such means for removably affixing second end 62 includes a hook and loop fastener fastening second end 62 to first end 64. To enable the fastening, second end 62 includes a surface of minute hooks 66 for receiving a surface of first end 64 consisting of uncut pile or loops 68. Alternatively, first end 64 may include a surface of minute hooks for receiving a surface of second end 62 consisting of uncut pile or loops. Independent of the particular structure used, fastening second end 62 provides a secure removable attachment for the swim goggle retainment device that creates minimal discomfort in the normal usage of the swimsuit.

Figure 12:
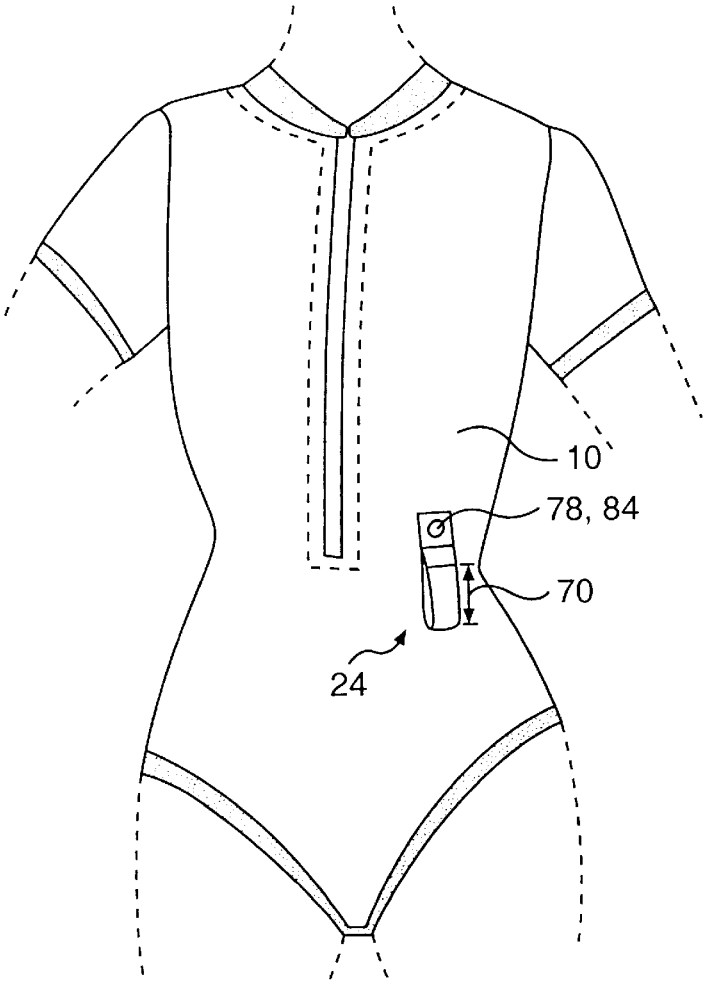
FIG. 12 is a front view of the embodiment showing a fourth variation of the loop according to the present invention.
Figure 13:
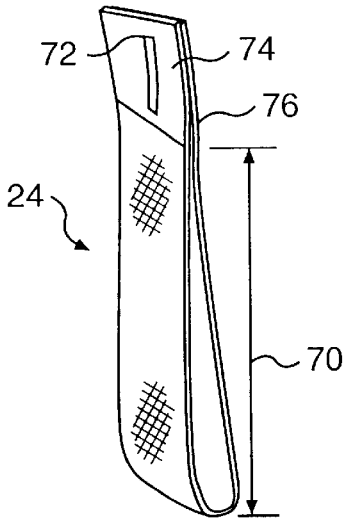
FIG. 13 is a perspective view of the embodiment showing a fourth variation of the loop according to the present invention.
Figure 14:
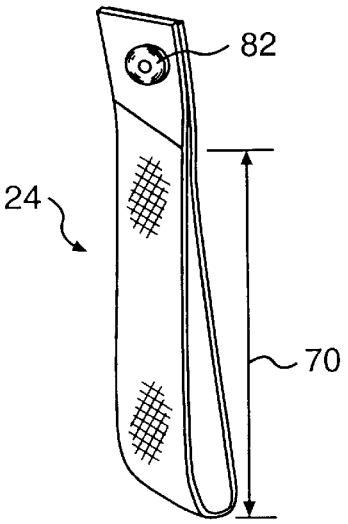
FIG. 14 is a perspective view of the embodiment showing a fourth variation of the loop according to the present invention.

As illustrated alternatively in FIGS. 12–14, loop 24 may removably affix to an exterior portion of swimsuit 10. Loop 24, made of a flexible elastic material, has an inner periphery 70 related to the lens frame of the swim goggles. Inner periphery 70 allows the insertion of one of the pair of lens frames of the swim goggles upon either flexing the material of the one lens frame or stretching the material of loop 24. The retainment technique offered by this variation not only enables the user to easily store their swim goggles but also allows the user to easily remove loop 24 from the exterior of swimsuit 10.

In certain swim wear applications advantages are obtained by removing the loop from the swimsuit exterior. One such application involves swimsuits designed specifically for swim competition. During the competition the existence of the loop on the swimsuit exterior may add to the frictional drag of the competitor. For this reason, removal of the loop from the swimsuit exterior prior to competition maximizes the performance of the swimsuit. Thus, by removably affixing the loop, the competitor enjoys the design benefits of the swimsuit and the retainment device for swim goggles.

In addition to its competitive advantage, the removability of the loop allows the user to removably affix loops of varying inner periphery to the exterior portion of the swimsuit. This adaptability may prove necessary where the user possesses multiple swim goggles, each having lens frames of differing dimensions.

Loop 24 may be removably affixed to the exterior portion of swimsuit 10 by various means. One such means includes buttoning loop 24 to the exterior of swimsuit 10. As illustrated in FIG. 13, to enable its buttoning, loop 24 includes button slot 72 disposed at ends 74, 76 for removably receiving button 78 attached to the exterior portion of swimsuit 10. Buttoning loop 24 to the exterior of swimsuit 10 provides a secure removable attachment for the swim goggle retainment device that creates minimal discomfort in the normal usage of swimsuit 10.

As illustrated in FIG. 14, another such means for removably affixing loop 24 includes snapping loop 24 to the exterior portion of swimsuit 10. To enable the snapping, loop 24 and the exterior portion 80 of swimsuit 10 include respective complementary structures 82, 84 that removably interlock once imposed onto one another. Similar to buttoning, snapping loop 24 to the exterior of swimsuit 10 provides the swim goggle retainment device with a secure removable attachment that creates minimal discomfort in the normal usage of swimsuit 10.

Yet another such means for removably affixing loop 24 includes fastening loop 24 to the exterior portion of swimsuit 10 by a hook and loop fastener. To enable the fastening, loop 24 includes a surface of minute hooks for receiving a surface of the exterior portion of the swimsuit 10 consisting of uncut pile or loops. Alternatively, the exterior portion of the swimsuit 10 may include a surface of minute hooks for receiving a surface of loop 24 consisting of uncut pile or loops. Independent of the particular structure used, fastening loop 24 to the exterior of swimsuit 10 provides the swim goggle retainment device with a secure removable attachment that creates minimal discomfort in the normal usage of the swimsuit 10.

It will be apparent to those skilled in the art that various modifications and variations can be made in the article of swim wear of the present invention and in construction of this article of swim wear without departing from the scope or spirit of the invention. As an example, the loop affixed to the article of swim wear is not limited to a double-ended loop, but may further include a closed loop or a butterfly loop capable of retaining multiple swim goggles. In addition, multiple loops may be affixed throughout the exterior portion of the swimsuit to retain multiple pairs of swim goggles. The swimsuit design is not limited to the design illustrated but may include a multitude of design variations, such as a vest, jacket, trunks or any article of clothing designed for swimming or with swimsuits. Further, the loop is not limited to retaining swim goggles, as it may be used to retain other items related to swim wear.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An article of swim wear with a retaining device for swim goggles having a pair of lens frames of elastomeric material and spaced by a nose piece, the article comprising:

a swimsuit having an exterior portion; and a single closed loop of flexible material affixed to the exterior portion of the swimsuit, the loop including a strip having two ends in contact with each other to form the single closed loop, the loop having an inner periphery related to the lens frames of the swim goggles so that one of the pair of lens frames may be inserted through the loop upon flexing the elastomeric material of the one lens frame and retaining the swim goggles by engagement of the loop with the nose piece of the swim goggles.

2. The article recited in claim 1, wherein said two ends of the strip are affixed to the exterior portion of the swimsuit to form a double-ended loop.

3. The article recited in claim 2, wherein said two ends of the strip are permanently affixed to the exterior portion of the swimsuit.

4. The article recited in claim 3, wherein said loop is formed by stitching the strip ends to the exterior portion of the swimsuit.

5. The article recited in claim 3, wherein said loop affixes to the swimsuit by pasting the loop to the exterior portion of the swimsuit.

6. The article recited in claim 2, wherein said loop of flexible material is elastic, where the inner periphery of the loop increases so that one of the pair of lens frames may be inserted through the loop, where the elasticity of the loop causes the inner periphery to return to substantially an original length.

7. The article recited in claim 1, wherein said loop of flexible material is elastic, where the inner periphery of the loop increases so that one of the pair of lens frames may be inserted through the loop, where the elasticity of the loop causes the inner periphery to return to substantially an original length.

8. The article recited in claim 1, wherein said loop affixes to the exterior portion of the swimsuit at a junction, said junction being covered by a label.

9. The article recited in claim 8, where said label has an upper surface defining a display surface for information.

10. The article recited in claim 9, wherein said swimsuit being of a stretchable fabric to conform to the body of a person wearing the swimsuit, where said loop affixes to the exterior hip portion of the swimsuit.

11. The article recited in claim 1, wherein said loop removably affixes to the exterior portion of the swimsuit.

12. The article recited in claim 11, where said loop is removably affixed to the swimsuit exterior by buttoning the loop to the exterior portion of the swimsuit.

13. The article recited in claim 12, where said loop includes a button slot for removably receiving a button attached to said exterior portion of the swimsuit.

14. The article recited in claim 12, where said exterior portion of the swimsuit includes a button slot for removably receiving a button attached to said loop.

15. The article recited in claim 11, where said loop is removably affixed to the swimsuit exterior by snapping the loop to the exterior portion of the swimsuit, where the loop and the exterior portion of the swimsuit include complementary structures removably interlocking once imposed onto one another.

16. The article recited in claim 11, where said loop is removably affixed to the swimsuit exterior by fastening the loop to the exterior portion of the swimsuit.

17. The article recited in claim 16, where the loop includes a surface of loops and the exterior portion of the swimsuit includes a complementary receiving surface of minute hooks.

18. The article recited in claim 16, where the loop includes a surface of minute hooks and the exterior portion of the swimsuit includes a complementary receiving surface of loops.

19. The article recited in claim 1, wherein said swimsuit being any article of clothing designed for swimming or with swim wear.

20. The article recited in claim 1, wherein the material of said loop being one of a fabric and a plastic.

21. An article of swim wear with a retaining device for swim goggles having a pair of lens frames spaced by a nose piece, the article comprising:

a swimsuit having an exterior portion; and a single closed loop of elastic flexible material affixed to the exterior portion of the swimsuit, the loop including a strip having two ends in contact with each other to form the single closed loop, the loop having an inner periphery related to the lens frames of the swim goggles so that one of the pair of lens frames may be inserted through the loop upon stretching the elastic material of the loop and retaining the swim goggles by engagement of the loop with the nose piece of the swim goggles.

22. The article recited in claim 21, wherein said two ends of the strip are affixed to the exterior portion of the swimsuit to form a double-ended loop.

23. The article recited in claim 22, wherein said two ends of the strip are permanently affixed to the exterior portion of the swimsuit.

24. An article of swim wear with a retaining device for swim goggles having a pair of lens frames spaced by a nose piece, the article comprising:

a swimsuit having an exterior portion; and a strip of material having a first end and a second end, the first end affixed to the exterior portion of the swimsuit and the second end removably affixed to the first end to form a single closed loop, the loop having an inner periphery related to the nose piece of the swim goggles so that the swim goggles may be retained by engagement of the loop with the nose piece of the swim goggles upon the attachment of the second end of the strip to the first end while the nose piece of the swim goggles resides on the strip.

25. The article recited in claim 21, wherein said loop is a double-ended loop.

26. The article recited in claim 21, where said second end of the strip is removably affixed to the swimsuit exterior by buttoning the second end to the first end of the strip.

27. The article recited in claim 26, where said second end includes a button slot for removably receiving a button attached to the first end of the strip.

28. The article recited in claim 26, where said first end of the strip includes a button slot for removably receiving a button attached to the second end of the strip.

29. The article recited in claim 24, where said second end of the strip is removably affixed to the swimsuit exterior by snapping the second end to the first end of the strip, where the first and second ends of the strip include complementary structures removably interlocking once imposed onto one another.

30. The article recited in claim 24, where said second end of the strip is removably affixed to the swimsuit exterior by fastening the second end to the first end of the strip.

31. The article recited in claim 30, where the first end of the strip includes a surface of loops and the second end of the strip includes a complementary receiving surface of minute hooks.

32. The article recited in claim 30, where the first end of the strip includes a surface of minute hooks and the second end of the strip includes a complementary receiving surface of loops.

33. An article of swim wear with a retaining device for swim goggles having a pair of lens frames spaced by a nose piece, the article comprising:

a swimsuit having an exterior portion; and a single closed loop of flexible material affixed to the exterior portion of the swimsuit, the loop including a strip having two ends in contact with each other to form the single closed loop, the loop having an inner periphery related to the swim goggles so that the swim goggles may be retained to the exterior portion of the swimsuit by engagement of the loop with the nose piece of the swim goggles.

34. A retaining device for retaining a pair of swim goggles to an exterior portion of an article of swim wear, the swim goggles having a pair of lens frames spaced by a nose piece, the device comprising:

a single closed loop of flexible material affixed to the exterior portion of the article of swim wear, the loop including a strip having two ends in contact with each other to form the single closed loop, the loop having an inner periphery related to the swim goggles so that the swim goggles may be retained to the exterior portion of the article of swim wear by engagement of the loop with the nose piece of the swim goggles.

* * * * *

UNITED STATES PATENT AND TRADEMARK OFFICE

CERTIFICATE OF CORRECTION

PATENT NO. : 5,987,650

DATED : November 23, 1999

INVENTOR(S) : CARROLL

It is certified that error appears in the above-identified patent and that said Letters Patent is hereby corrected as shown below:

On the Title page, item [54], and col. 1, line 1

In the Title, front page: Line 1, change "GOOGLE" TO --GOGGLE--.

Claim 25, Column 8, Line 34, change "claim 21" to --claim 24--.

Claim 26, Column 8, Line 36, change "claim 21" to --claim 24--.

Signed and Sealed this

Sixteenth Day of May, 2000

*Attest:*

Q. TODD DICKINSON

*Attesting Officer*

*Director of Patents and Trademarks*